US011326232B2

(12) United States Patent
Kernig et al.

(10) Patent No.: US 11,326,232 B2
(45) Date of Patent: May 10, 2022

(54) ALUMINUM STRIP FOR LITHOGRAPHIC PRINTING PLATE CARRIERS AND THE PRODUCTION THEREOF

(71) Applicants: Bernhard Kernig, Cologne (DE); Henk-Jan Brinkman, Bonn (DE); Jochen Hasenclever, Bonn (DE); Christoph Settele, Mönchengladbach (DE); Gerd Steinhoff, Bonn (DE)

(72) Inventors: Bernhard Kernig, Cologne (DE); Henk-Jan Brinkman, Bonn (DE); Jochen Hasenclever, Bonn (DE); Christoph Settele, Mönchengladbach (DE); Gerd Steinhoff, Bonn (DE)

(73) Assignee: Hydro Aluminium Deutschland GmbH, Grevenbroich (DE)

( * ) Notice: Subject to any disclaimer, the term of this patent is extended or adjusted under 35 U.S.C. 154(b) by 260 days.

(21) Appl. No.: 15/494,285

(22) Filed: Apr. 21, 2017

(65) Prior Publication Data

US 2017/0253952 A1 Sep. 7, 2017

Related U.S. Application Data

(62) Division of application No. 12/744,173, filed as application No. PCT/EP2008/066086 on Nov. 24, 2008, now abandoned.

(30) Foreign Application Priority Data

Nov. 30, 2007 (EP) ..... 07023245

(51) Int. Cl.
*C22C 21/08* (2006.01)
*C22C 21/00* (2006.01)
(Continued)

(52) U.S. Cl.
CPC ..... *C22C 21/08* (2013.01); *B41N 1/083* (2013.01); *C22C 21/00* (2013.01); *C22C 21/06* (2013.01);
(Continued)

(58) Field of Classification Search
CPC ..... C22C 21/08; C22C 21/00; B41N 1/083
(Continued)

(56) References Cited

U.S. PATENT DOCUMENTS 3,563,815 A 2/1971 Meier et al.
4,435,230 A 3/1984 Fujikura
(Continued)

FOREIGN PATENT DOCUMENTS

EP 0 211 574 A1 2/1987
EP 0 257 957 A1 3/1988
(Continued)

OTHER PUBLICATIONS

Totten, G.E. and MacKenzie, D.S. "Aluminum Alloy Nomenclatutre and Temper Designations", ASM Handbook, vol. 4E, Heat treating of Nonferrous Alloys, p. 114-136. (Year: 2016).*
(Continued)

*Primary Examiner* — George Wyszomierski
*Assistant Examiner* — Janell C Morillo
(74) *Attorney, Agent, or Firm* — Reinhart Boerner Van Deuren P.C.

(57) ABSTRACT

A method for producing aluminum strips for lithographic printing plate supports, wherein the aluminum strip is produced from a rolling ingot, which after optional homogenizing is hot-rolled to a thickness of 2 mm to 7 mm and cold-rolled to a final thickness of 0.15 mm to 0.5 mm provides for an aluminum strip having a thickness of 0.15 mm to 0.5 mm and a printing plate support produced from the aluminum strip.

8 Claims, 1 Drawing Sheet

(51) Int. Cl.

| | |
|---|---|
| ***B41N 1/08*** | (2006.01) |
| ***C22F 1/04*** | (2006.01) |
| ***C22F 1/047*** | (2006.01) |
| ***C22C 21/06*** | (2006.01) |

(52) U.S. Cl.
CPC ..... *C22F 1/04* (2013.01); *C22F 1/047* (2013.01); *Y10T 428/12431* (2015.01)

(58) Field of Classification Search
USPC ..... 148/552, 692; 430/278.1, 526
See application file for complete search history.

(56) References Cited

U.S. PATENT DOCUMENTS

| | | | |
|---|---|---|---|
| 4,686,083 | A | 8/1987 | Takizawa et al. |
| 4,715,903 | A | 12/1987 | Asten et al. |
| 4,729,939 | A | 3/1988 | Nishikawa et al. |
| 4,822,715 | A | 4/1989 | Shoji et al. |
| 6,447,982 | B1 | 9/2002 | Von Asten et al. |
| 6,494,137 | B2 | 12/2002 | Sawada et al. |
| 2004/0047759 | A1 | 3/2004 | Rottwinkel et al. |
| 2006/0254680 | A1 | 11/2006 | Rottwinkel et al. |
| 2008/0035488 | A1 | 2/2008 | Del Rio Martin et al. |
| 2009/0016928 | A1 | 1/2009 | Kernig et al. |
| 2011/0039121 | A1 | 2/2011 | Kernig et al. |

FOREIGN PATENT DOCUMENTS

| | | | |
|---|---|---|---|
| EP | 0 853 132 | A1 | 7/1998 |
| EP | 0 887 430 | A1 | 12/1998 |
| EP | 1 065 071 | A1 | 1/2001 |
| EP | 1 172 228 | A2 | 1/2002 |
| EP | 1 065 071 | B1 | 11/2004 |
| EP | 1 676 931 | A2 | 7/2006 |
| EP | 2 067 871 | A1 | 6/2009 |
| JP | 60005861 | A | 1/1985 |
| JP | 61-026746 | | 2/1986 |
| JP | 62-086143 | A | 4/1987 |
| JP | 62080255 | A | 4/1987 |
| JP | 62181190 | A | 8/1987 |
| JP | 62181191 | A | 8/1987 |
| JP | 63-047347 | | 2/1988 |
| JP | 63-047348 | | 2/1988 |
| JP | 63-047349 | A | 2/1988 |
| JP | 11061364 | A | 3/1999 |
| JP | 11161364 | A | 6/1999 |
| WO | WO 02/48415 | A1 | 6/2002 |
| WO | WO 2006/122852 | A1 | 11/2006 |
| WO | WO 2007/045676 | A1 | 4/2007 |
| WO | WO 2007/115167 | A2 | 10/2007 |

OTHER PUBLICATIONS

D.G. Altenpohl; Aluminium: Technology, Applications and Environment; Section 7.6.3; Jan. 11, 2000; 3 pages.

Dr. Catrin Kammer; Aluminium—Taschenbuch, 1995, Band 1: Grundlagen und Werkstoffe, Düsseldorf; Germany; pp. 153-155.

G. Forrest and Sheet Material Industries; Fatigue Properties of Aluminium Alloys; 1957, pp. 831-845.

J.C. Grosskreutz and G.G. Shaw; Critical Mechanisms in the Development of Fatigue Cracks in 2024-T4 Aluminum; AFML-TR-68-137, May 1968; 38 pages.

W.M. Johnston; Fracture Tests on Thin Sheet 2024-T3 Aluminum Alloy for specimens With and Without Anti-Buckling Guides; NASA/CR-2001-210832; Mar. 2001; 40 pages.

L. J. Cartmell et al., Hot Rolling of Sheet and Strip; Metals Technology, 1975, pp. 313-317.

Guy Buytaert; Study of the (sub)Surface on Rolled Commercially Pure Aluminium Alloys; PhD Thesis, 2005; 7 pages.

T2003/09-3.2.08—Decision on Appeal in related application, Feb. 7, 2012.

G. Buytaert et al., Influence of surface pre-treatments on disturbed rolled-in subsurface layers of aluminium alloys, Surface & Coatings Technology 201, Science Direct, Jun. 21, 2006, 12 pages, Elsevier B.V.

G. Buytaert et al., Study of the near-surface of hot- and cold-rolled AlMg0.5 aluminium alloy, Surf. Interface Anal. 2005, Surface and Interface Analysis, Apr. 7, 2015, 10 pages, Wiley InterScience, John Wiley & Sons, Ltd.

ASM Handbooks Online, http://products.asminternational.org/hbk/index.jsp, Extracts. From vol. 8, Fatigue and Fracture, published in 2000, and vol. 19, Mechanical Testing and Evaluation, published in 1996, 7 pages.

Scott D. Henry et al.; Aluminum and Aluminum Alloys; ASM International, 1993, p. 41.

* cited by examiner

ALUMINUM STRIP FOR LITHOGRAPHIC PRINTING PLATE CARRIERS AND THE PRODUCTION THEREOF

CROSS-REFERENCE TO RELATED APPLICATIONS

This patent application is a divisional of co-pending U.S. patent application Ser. No. 12/744,173, filed Sep. 17, 2010, which is a National Phase Application of International Application No. PCT/EP2008/066086, filed Nov. 24, 2008, which claims the benefit of and priority to European Patent Application No. 07023245.9, filed Nov. 30, 2007, the entire teachings and disclosures of which are incorporated herein by reference thereto.

FIELD OF THE INVENTION

The invention relates to a method for producing aluminum strips for lithographic printing plate supports, wherein the aluminum strip is produced from a rolling ingot, which after optional homogenizing is hot-rolled to a thickness of 2 mm to 7 mm and cold-rolled to a final thickness of 0.15 mm to 0.5 mm. In addition, the invention relates to a correspondingly produced aluminum strip having a thickness of 0.15 mm to 0.5 mm and to a printing plate support produced from the aluminum strip according to the invention.

BACKGROUND OF THE INVENTION

Very high requirements are set for the quality of aluminum strips for producing lithographic printing plate supports. The aluminum strip for producing lithographic printing supports is usually subjected to an electrochemical roughening which should result in comprehensive roughening and a structureless appearance without any streaking effects. The roughened structure is important for applying a photosensitive layer which is then exposed. The photo layer is burned-in at temperatures of 220° C. to 300° C. and annealing times of 3 to 10 minutes, wherein typical combinations of burning-in times are, for example, 240° C. for 10 minutes, 260° C. for 6 minutes and 260° C. for 4 minutes. The printing plate support must lose as little strength as possible after the burning-in process, so that it can still be handled well and can be easily clamped into a printing device. At the same time, the printing plate support, and with it also the aluminum strip to be correspondingly produced, must possess as high a reversed bending fatigue strength as possible, so that the plate ruptures resulting from mechanical stresses on the printing plate can almost be excluded. Up to now, these requirements were able to be well met by conventional aluminum strips. However, in order to increase productivity, printing machines are increasingly being used which require the printing plate supports to be clamped in such a way that they are bent transverse to the rolling direction and are, therefore, also mechanically stressed transverse to the rolling direction. At the same time, handling large lithographic printing plate supports having an increasing size and unchanging strength values becomes more difficult.

For example, a strip for producing lithographic printing plate supports is known from the European Patent EP 1 065 071 B1, which can be traced back to the Patentee and which is characterized by very good roughenability combined with very high reversed bending fatigue strength and sufficient thermal stability after a burning-in process. Due to the increasing size of the printing machines and the increase in size of the required printing plate supports resulting from this, it has, however, been necessary to further improve the properties of the known aluminum alloy and the lithographic printing plate supports produced from them. Simply increasing the tensile strengths, which is possible, for example, by changing the aluminum alloy, did not produce the desired success, since with high tensile strength, correcting the coil set of the aluminum strip became more difficult. This is usually carried out in the hard-as-rolled state before the burning-in process.

SUMMARY OF THE INVENTION

Taking this as the starting point, an aspect of the present invention is to provide a method for producing an aluminum strip for lithographic printing plate supports, and a corresponding aluminum strip, from which outsized printing plate supports can also be produced which are easy to handle and are only slightly prone to plate ruptures.

According to a first teaching of the present invention, the above disclosed aspect is procedurally achieved in that the aluminum strip consists of an aluminum alloy having the following alloying constituents in weight percent:

$0.3\% \leq Fe \leq 0.4\%$, $0.2\% \leq Mg \leq 1.0\%$, $0.05\% \leq Si \leq 0.25\%$, $Mn \leq 0.1\%$, optionally $Mn \leq 0.05\%$, $Cu \leq 0.04\%$, with the remainder Al and unavoidable impurities, individually max. 0.05%, in total max. 0.15%; during cold-rolling an intermediate annealing at a thickness of 1.5 mm to 0.5 mm is carried out, the aluminum strip is then rolled to a final thickness of 0.15 mm to 0.5 mm by cold-rolling and is coiled in a hard-as-rolled state for further processing into a lithographic printing plate support.

The aluminum strip produced according to the invention provides a moderate increase in strength together with a very high reversed bending fatigue strength and, at the same time, very good thermal stability. Coil set corrections are possible without difficulty due to the moderate increase in strength. At the same time, however, the handling of the printing plate is also easy even in the burned-in state, for example when clamping it into the printing machine, since good thermal stability of the aluminum strip is obtained with the method according to the invention. If the aluminum strip is used for the production of very large lithographic printing plate supports, the aluminum strip is preferably cold-rolled to a final thickness of 0.25 mm to 0.5 mm after the intermediate annealing. The particular applicability of the aluminum strips, produced according to the method according to the invention, for outsized lithographic printing plate supports results from the fact that because of the low rolling-down degrees and the increased magnesium content, higher strengths and reversed bending fatigue strength can be provided which make handling easier and enable the durability of the printing plate supports to be improved. Manganese contributes to thermal stability in the alloy. However, in combination with the other alloying constituents, in particular the magnesium proportions, problems with regard to roughenability arose with a content of more than 0.1 wt. %. If the manganese content does not exceed 0.05 wt. % a good compromise is achieved between thermal stability and roughening properties.

According to a first embodiment of the method according to the invention, the aluminum alloy has an Mg content of 0.4 wt. % to 1.0 wt. %, preferably 0.6 wt. % to 1 wt. %. The high to very high Mg contents in the aluminum alloy for producing lithographic printing plate supports result in considerably increased reversed bending fatigue strength in the produced printing plate supports transverse to the rolling direction. At the same time, contrary to the expectations of experts in the field, no problems arose when the strips produced from a corresponding aluminum alloy were roughened. Higher Mg contents enable the rolling-down degrees after intermediate annealing to be reduced while at the same time maintaining or increasing the tensile strength values, in particular also transverse to the rolling direction.

If the aluminum alloy, according to a subsequent, alternative embodiment of the present invention, has a Mg content of 0.25 wt. % to 0.6 wt. %, preferably 0.3 wt. % to wt. %, good strength values can be provided with high reversed bending fatigue strength. This particularly applies with a Mg content of 0.4 wt. % to 0.6 wt. %.

According to an embodiment of the present invention, the properties according to the invention can be particularly reliably obtained in that the aluminum alloy additionally has a titanium (Ti) content of max. 0.05 wt. %, preferably max. 0.015 wt. %, a zinc (Zn) content of max. 0.05 wt. % and a chromium (Cr) content of less than 100 ppm, preferably a Cr content of max. 50 ppm. Titanium is usually used for grain refinement during casting. An increased Ti content, however, leads to casting problems. Zinc affects the roughenability, so that its content should be max. 0.05 wt. %. Typical problems arise with an increased Zn content due to inhomogeneities when the lithographic printing plate supports are roughened. Chromium inhibits re-crystallization and should, therefore, only be included in the aluminum alloy in very small proportions of less than 100 ppm, preferably of max. 50 ppm.

By setting the hot-rolling temperatures within the range from 250° C. to 550° C., in which the hot strip final temperature is 280° C. to 350° C., persistent re-crystallization of the surface is achieved during hot-rolling, which, for example, ensures that the wall surface can be roughened well during production of the lithographic printing plate supports.

Preferably, the metal temperature of the aluminum strip is 200° C. to 450° C. during intermediate annealing. The aluminum strip is then held at the metal temperature for at least one to two hours. This usually takes place in batch furnaces. The aluminum strip can be further processed either in the recovered or re-crystallized state, or a combination of both, by means of the intermediate annealing in the temperature range mentioned. The re-crystallization begins at temperatures from about 300 to 350° C., wherein this is dependent on the manufacturing parameters, in particular on the strain hardening introduced. In contrast, only a reduction of the strain hardening can be achieved by recovery annealing at lower temperatures, so that very low rolling-down degrees are possible after recovery annealing. Depending on the respective rolling-down degrees after intermediate annealing and the alloying composition, it may, however, also be necessary to carry out re-crystallization annealing as intermediate annealing.

According to a second teaching of the present invention, the above disclosed aspect is achieved by a generic aluminum strip for producing lithographic printing plate supports, which consists of an aluminum alloy having the following alloying constituents in wt. %:

0.3%≤Fe≤0.4%,
0.2%≤Mg≤1.0%,
1.4%≤Si≤0.25%,
Mn≤0.1%, optionally Mn≤0.05%,
Cu≤0.04%, with the remainder Al and unavoidable impurities, individually max. 0.05%, in total max. 0.15%; the aluminum strip has a reversed bending fatigue strength transverse to the rolling direction of at least 1,850 cycles in the reversed bending test.

In the reversed bending test, a slat is cut out of the aluminum strip and bent back and forth between two cylindrical segments having a radius of 30 mm. In contrast to the aluminum strips for lithographic printing plate supports produced up to now, the aluminum strips according to the invention after a burning-in process achieve reversed bending cycles of more than 1,850, even transverse to the rolling direction, which represents an increase of over 70% compared to the standard alloys used up to now. In addition, the high number of possible reversed bending cycles of more than 1,850 shows both in the hard-as-rolled state and in the burned-in state of the aluminum strip according to the invention that proneness to plate ruptures due to mechanical stresses is low with lithographic printing plate supports clamped transverse or longitudinal to the rolling direction.

Preferably, the aluminum strips have a tensile strength of up to 200 MPa measured in the hard-as-rolled state longitudinal to the rolling direction, so that the coil set of the aluminum strip according to the invention can still be easily corrected. The increase in the tensile strength values is preferably coupled with good thermal stability which manifests by a tensile strength of at least 145 MPa after a burning-in process longitudinal or transverse to the rolling direction. Handling of the lithographic printing plate supports produced from the aluminum strip is also good after a burning-in process. Even with very large lithographic printing plate supports the handling of the printing plates can be made easier by means of the increased strengths after the burning-in process. With increased Mg contents, tensile strength values up to a maximum of 200 MPa can be obtained in the hard-as-rolled state by reducing the intermediate annealing thickness which then, for example, is lower than 1.1 mm. The reversed bending fatigue strength is not affected by this.

An aluminum strip having a Mg content of 0.25 wt. % to 0.6 wt. %, preferably 0.3 wt. % to 0.4 wt. %, enables sufficiently high tensile strength values to be provided in the hard-as-rolled state, since, for example, the required strength values for aluminum strip are already obtained with low rolling-down degrees after the intermediate annealing. Aluminum strips having a Mg content of 0.4 wt. % to 0.6 wt. % show a further increase in reversed bending fatigue strength transverse to the rolling direction with unchanging properties with respect to roughenability and improved tensile strength properties.

An alternative embodiment of the aluminum strip according to the invention has a Mg content of 0.4 wt. % to 1.0 wt. %, preferably 0.6 wt. % to 1.0 wt. %. Aluminum strips having these increased Mg contents are characterized by an exceptionally good reversed bending fatigue strength transverse to the rolling direction and are not, contrary to the expectations of experts in the field, prone to streakiness during roughening. Only the intermediate annealing thickness has to be adjusted in order to obtain optimum tensile strength values of less than 200 MPa with maximum reversed bending fatigue strength properties.

According to another embodiment of the aluminum strip according to the invention, the properties of the finished aluminum strip are reliably obtained in that the aluminum alloy has a Ti content of max. 0.05 wt. %, preferably max. 0.015 wt. %, a Zn content of max. 0.05 wt. % and a Cr content of less than 100 ppm, preferably of max. 10 ppm.

According to a last embodiment of the aluminum strip according to the invention, outsized printing plate supports can be produced particularly well from aluminum strips having a thickness of 0.25 to 0.5 mm and they can be processed and handled easily.

According to a third teaching of the present invention, the above disclosed aspect is achieved by printing plate supports which are produced from an aluminum strip according to the invention. As regards the advantages of the printing plate supports according to the invention, reference is made to the above explanations for the method for producing an aluminum strip and for the aluminum strip according to the invention.

There are a plurality of possible embodiments of the method according to the invention for producing aluminum strips for lithographic printing plate supports, the aluminum strip according to the invention for lithographic printing plate supports and the printing plate support according to the invention. Reference is made for illustration purposes to the description of exemplary embodiments in conjunction with the drawing. In the drawing, the single FIGURE shows a schematic illustration of the reversed bending test for testing reversed bending fatigue strength.

DESCRIPTION

Figure 1A:
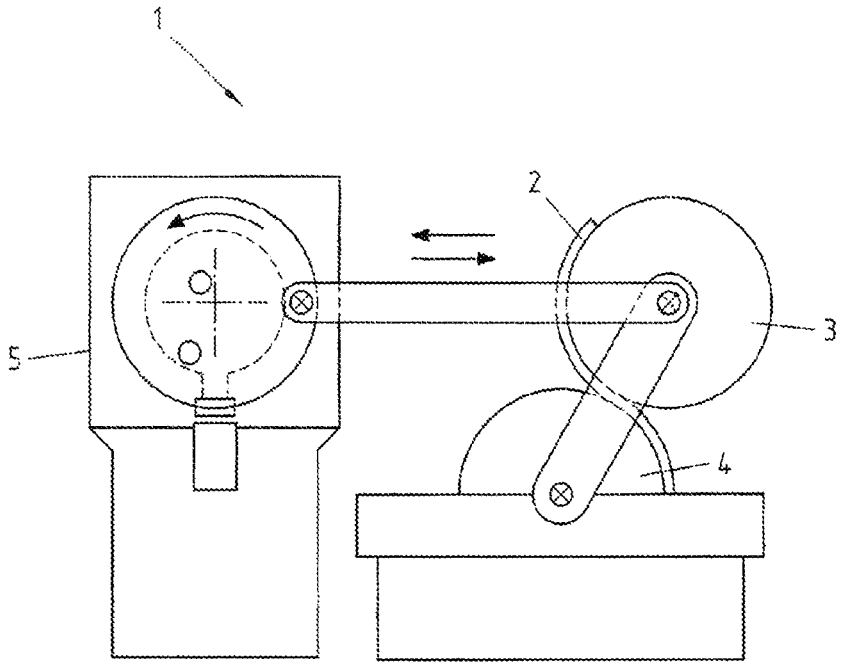
FIG. 1*a*) shows in a schematic sectional view the configuration of the reversed bending test apparatus used.

A comparison between a conventional aluminum strip for producing lithographic printing plate supports and two aluminum strips according to the invention and a comparison aluminum strip, which are also suitable for producing lithographic printing plate supports, is presented in the following. The alloying constituents of the different, tested aluminum strips are shown in Table 1.

TABLE 1

| Alloy No. | Fe | Mn | Mg | Si | Cu | wt. % |
|---|---|---|---|---|---|---|
| Vref | 0.32 | — | 0.17 | 0.12 | 7 ppm | Prior art |
| VF583 | 0.3 | 0.0291 | 0.97 | 0.11 | 0.0233 | Invention |
| V582 | 0.36 | 0.0034 | 0.3 | 0.09 | 3 ppm | Invention |
| V581 | 0.36 | 0.018 | 0.2 | 0.08 | 5 ppm | Invention |
| V580 | 0.4 | 0.10 | 0.11 | 0.08 | <10 ppm | Comparison |

Table 1 only shows the essential alloying constituents of the aluminum strips tested and furthermore the different test alloys had a Ti content of less than 0.015 wt. %, a Zn content of less than 0.05 wt. % and a Cr content of less than 100 ppm. The rolling ingots cast from the different aluminum alloys were subjected to homogenizing prior to rolling, wherein the rolling ingots were annealed to a temperature of about 580° C. for more than four hours. Subsequently, hot-rolling was carried out at temperatures of 250° C. to 550° C., wherein the hot-rolling final temperature was between 280° C. and 350° C. The aluminum hot strip consisting of the Vref alloy was subjected to an intermediate annealing during cold-rolling at a thickness of 2 to 2.4 mm, wherein the cold-rolled strip was exposed to a temperature of 300 to 450° C. for one to two hours. For the V581, V582 and VF583 aluminum strips the intermediate annealing thickness was only 0.9 to 1.2 mm at the same intermediate annealing temperatures, as can also be seen from Table 2. The aluminum strip consisting of the V580 alloy was, in contrast, not subjected to intermediate annealing. Since the intermediately annealed strips were cold-rolled further to a final thickness, without final annealing taking place, these were coiled in the hard-as-rolled state.

TABLE 2

| Alloy No. | Hot strip final thickness | Intermediate annealing thickness | Final thickness | State |
|---|---|---|---|---|
| Vref | 3-4 mm | 2-2.4 mm | 0.29 mm | hard-as-rolled |
| VF583 | 3-4 mm | 0.9-1.2 mm | 0.28 mm | hard-as-rolled |
| V582 | 3-4 mm | 0.9-1.2 mm | 0.28 mm | hard-as-rolled |
| V581 | 3-4 mm | 0.9-1.2 mm | 0.28 mm | hard-as-rolled |
| V580 | 3-4 mm | — | 0.28 mm | hard-as-rolled |

The correspondingly produced aluminum strips for lithographic printing plate supports or lithostrips were subjected to further tests. All five aluminum strips are characterized by very good roughening characteristics. Furthermore, the tensile strength was tested in the hard-as-rolled state. In order to test the practical handling of the printing plates, particularly with outsized lithographic printing plates, tensile strengths were also measured after a burning-in process of 240° C. for 10 minutes. In addition, a reversed bending test was carried out, in which the test arrangement illustrated schematically in FIG. 1 was used.

Figure 1B:
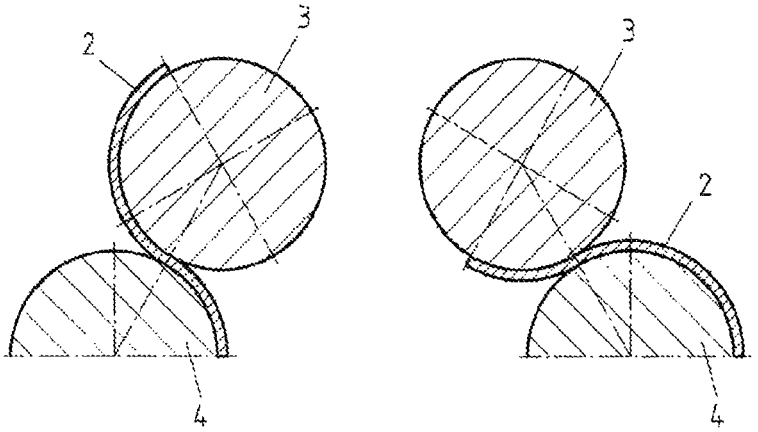
FIG. 1*b*) shows in a schematic cross-sectional view the different bending states of the reverse bending test.

FIG. 1*a*) shows in a schematic sectional view the configuration of the reversed bending test apparatus 1 used, which was employed to test the reversed bending fatigue strength of the aluminum strips according to the invention. Samples 2 from the aluminum strips for lithographic printing plate supports produced are attached to a movable segment 3 and to a fixed segment 4 on the reversed bending test apparatus 1. In the reversed bending test, the segment is moved back and forth on the fixed segment 4 by means of a rolling movement, so that the sample 2 is exposed to bending perpendicular to the extent of the sample 2. FIG. 1*b*) shows the different bending states. The samples 2 were cut out of the aluminum strips for lithographic printing plate supports produced either longitudinal or transverse to the rolling direction. The radius of the segments 3, 4 was 30 mm.

The tensile strengths were measured in accordance with DIN. The results of the tensile strength measurements in the hard-as-rolled state or after a burning-in process, as well as the reversed bending test results, are illustrated in Tables 3a and 3b.

TABLE 3a

| | Tensile strength (MPa) hard- as-rolled | | Tensile strength (MPa) 240° C./10 min | |
|---|---|---|---|---|
| Alloy No. | longitud. | transverse | longitud. | transverse |
| Vref | 198 | 201 | 154 | 154 |
| VF583 | 212 | 223 | 179 | 185 |
| V582 | 184 | 201 | 153 | 161 |
| V581 | 177 | 192 | 145 | 155 |
| V580 | 218 | 228 | 157 | 169 |

TABLE 3b

| | Reversed bending test after 260° C./4 min Number of | | Reversed bending test hard-as-rolled Number of cycles | |
|---|---|---|---|---|
| Alloy No. | longitud. | transverse | longitud. | transverse |
| Vref | 3400 | 1500 | 3030 | 1930 |
| VF583 | 4150 | 3430 | 3760 | 2950 |
| V582 | 4570 | 2670 | 4070 | 2320 |
| V581 | 4230 | 2150 | 4100 | 2000 |
| V580 | 3190 | 2090 | 2840 | 2200 |

It was revealed that the conventional aluminum strip indeed had sufficient tensile strength for correcting the coil set before the burning-in process and for handling the lithographic printing plate support after the burning-in process, and sufficient reversed bending fatigue strength longitudinal to the rolling direction. Transverse to the rolling direction, the conventionally produced aluminum strip (Vref) only achieved 1500 bending cycles. The V582 and V581 aluminum strips according to the invention, on the other hand, exhibit very good tensile strengths in relation to a coil set correction and the handling of the printing plate after a burning-in process and very high reversed bending fatigue strength. An up to 78% higher number of bending cycles was achieved, cf. V582 alloy. Compared to this, the V580 comparison aluminum strip also, in fact, exhibited good values with regard to reversed bending fatigue strength. The very high tensile strengths of 218 and 228 MPa, longitudinal and transverse, respectively, to the rolling direction, make correction of the coil set difficult before burning-in the photo layer of the lithographic printing plate supports.

The aluminum strips consisting of the VF583 aluminum alloy also exhibited increased tensile strength values of 212 MPa and 223 MPa longitudinal and transverse, respectively, to the rolling direction. The increase in the reversed bending fatigue strength, however, is very distinct with a factor of about 2.47 compared to the reference material transverse to the rolling direction after the burning-in process. An increase in the reversed bending fatigue strength by a factor of 1.27 still arises anyway longitudinal to the rolling direction after a burning-in process. Coupled with unproblematic roughenability, this produces an outstanding suitability of the VF583 aluminum alloy for outsized printing plate supports clamped transverse to the rolling direction. It is assumed that the improved reversed bending fatigue strength properties are brought about by the increased Mg proportion of 0.97 wt. % in the VF583 alloy. The tensile strength values of the VF583 alloy can, however, be reduced still further by a further reduction in the intermediate annealing thickness, for example to between 0.9 mm and less than 1.1 mm, without the reversed bending fatigue strength properties being impaired.

In the hard-as-rolled state, which is used for negative printing plates, a distinct improvement in the reversed bending fatigue strength arose particularly longitudinal to the rolling direction. The values likewise increased transverse to the rolling direction. This in particular also applies for the VF583 aluminum alloy which allowed a maximum number of bending cycles transverse to the rolling direction even in the hard-as-rolled state.

It was revealed that selecting an aluminum alloy specifically matched to the requirements of large lithographic printing plate supports, in combination with selected method parameters, enables distinctly improved lithographic printing plate supports to be produced which even when using outsized ones, i.e. when these are clamped transverse to the rolling direction, can be easily handled and yet are resistant to plate ruptures.

What is claimed is:

1. Aluminium strip for producing lithographic printing plate supports, having a thickness of 0.15 mm to 0.5 mm, characterised in that the aluminium strip consists of an aluminium alloy having the following alloying constituents in weight percent:

0.3%≤Fe≤0.4%,
0.2%≤Mg≤1.0%,
0.05%≤Si≤0.25%,
Mn≤0.1%,
Cu≤0.04%, with the remainder Al and unavoidable impurities, individually max. 0.05%, in total max. 0.15%, wherein the aluminium strip is produced from a rolling ingot by homogenising the rolling ingot, hot-rolling the rolling ingot to a hot-rolled strip with a thickness of 2 mm to 5 mm, and cold-rolling the hot-rolled strip to a final thickness of 0.15 mm to 0.5 mm, wherein during cold-rolling an intermediate annealing at a thickness of 1.5 mm to 0.5 mm is carried out, wherein during intermediate annealing the metal temperature is 200° C. to 450° C. and the aluminium strip is held at the said metal temperature for at least one hour up to two hours, and wherein the aluminium strip has a reversed bending fatigue strength transverse to the rolling direction of at least 2320 cycles in a H18 temper state in a reversed bending test and the aluminium strip has a tensile strength of up to 200 MPa in the H18 temper state longitudinal to the rolling direction and a tensile strength of at least 145 MPa after a burning-in process longitudinal or transverse to the rolling direction.

2. Aluminium strip according to claim 1, characterised in that the aluminium alloy has a Mg content of 0.25 wt. % to 0.6 wt. %.

3. Aluminium strip according to claim 1, characterised in that the aluminium alloy has a Mg content of 0.4 wt. % to 1.0 wt. %.

4. Aluminium strip according to claim 1, characterised in that the aluminium alloy has a Ti content of max, 0.05 wt. %, a Zn content of max, 0.05 wt. % and a Cr content of less than 50 ppm.

5. Aluminium strip according to claim 1, characterised in that the aluminium alloy has a thickness of 0.25 to 0.5 mm.

6. Printing plate support produced from an aluminium strip according to claim 1.

7. Aluminium strip according to claim 1, wherein the aluminium alloy has an Mn content of max, 0.05 wt. %.

8. Aluminium strip for producing lithographic printing plate supports, having a thickness of 0.15 mm to 0.5 mm, characterised in that the aluminium strip consists of an aluminium alloy having the following alloying constituents in weight percent:

0.3%≤Fe≤0.4%,
0.2%≤Mg≤1.0%,
0.05%≤Si≤0.25%,
Mn≤0.1%,
Cu≤0.04%, with the remainder Al and unavoidable impurities, individually max. 0.05%, in total max. 0.15%, wherein the aluminium strip is produced from a rolling ingot by homogenising the rolling ingot, hot-rolling the rolling ingot to a hot-rolled strip with a thickness of 2 mm to the thickness of at most 4 mm, and cold-rolling the hot-rolled strip to a final thickness of 0.15 mm to 0.5 mm, wherein during cold-rolling an intermediate annealing at a thickness of 1.5 mm to 0.5 mm is carried out, wherein during intermediate annealing the metal temperature is 200° C. to 450° C. and the aluminium strip is held at the said metal temperature for at least one hour up to two hours, and wherein the aluminium strip has a reversed bending fatigue strength transverse to the rolling direction of at least 2320 cycles in a H18 temper state in a reversed bending test and the aluminium strip has a tensile strength of up to 200 MPa in the H18 temper state longitudinal to the rolling direction and a tensile strength of at least 145 MPa after a burning-in process longitudinal or transverse to the rolling direction.

* * * * *